US009089164B2

(12) United States Patent
Pastore et al.

(10) Patent No.: US 9,089,164 B2
(45) Date of Patent: Jul. 28, 2015

(54) TRANSFER OR FEED DRUM, WITH RADIAL-ARM-MOUNTED OPERATING HEADS, FOR FILTER OR CIGARETTE PORTIONS

(75) Inventors: Fulvio Pastore, Anzola dell'Emilia (IT); Massimo Sartoni, Bologna (IT)

(73) Assignee: G.D SOCIETA' PER AZIONI, Bologna (IT)

( * ) Notice: Subject to any disclaimer, the term of this patent is extended or adjusted under 35 U.S.C. 154(b) by 656 days.

(21) Appl. No.: 13/432,133

(22) Filed: Mar. 28, 2012

(65) Prior Publication Data

US 2012/0252647 A1 Oct. 4, 2012

(30) Foreign Application Priority Data

Mar. 28, 2011 (IT) ..... BO2011A0158

(51) Int. Cl.

| | |
|---|---|
| ***A24C 5/28*** | (2006.01) |
| ***A24D 3/02*** | (2006.01) |
| ***A24C 5/32*** | (2006.01) |
| ***B65G 29/00*** | (2006.01) |
| *A24C 5/47* | (2006.01) |

(52) U.S. Cl.

CPC ..... *A24D 3/0287* (2013.01); *A24C 5/28* (2013.01); *A24C 5/326* (2013.01)

(58) Field of Classification Search

CPC ..... A24D 3/02; A24D 3/0229; A24D 3/027; A24D 3/0275; A24D 3/0279; A24D 3/0287; A24C 5/46; A24C 5/465; A24C 5/28; A24C 5/326

USPC ..... 493/39–50

See application file for complete search history.

(56) References Cited

U.S. PATENT DOCUMENTS

| | | | | |
|---|---|---|---|---|
| 4,244,250 | A * | 1/1981 | Rudszinat | 83/310 |
| 5,255,777 | A * | 10/1993 | Pawelko | 198/471.1 |
| 5,984,851 | A * | 11/1999 | Irikura | 493/39 |
| 7,281,621 | B2 * | 10/2007 | Jahnke et al. | 198/471.1 |
| 8,464,724 | B2 * | 6/2013 | Balletti et al. | 131/88 |
| 2006/0076215 | A1 | 4/2006 | Jahnke et al. | |
| 2006/0213528 | A1 * | 9/2006 | Draghetti et al. | 131/88 |

(Continued)

FOREIGN PATENT DOCUMENTS

| | | | |
|---|---|---|---|
| CN | 101015393 | A | 8/2007 |
| CN | 101885418 | A | 11/2010 |

(Continued)

OTHER PUBLICATIONS

Office Action dated Aug. 26, 2014, issued in Chinese Patent Application No. CN 201210086900.3 (published as CN102715652 A), which corresponds to this application.

*Primary Examiner* — Thanh Truong
*Assistant Examiner* — Joshua Kotis
(74) *Attorney, Agent, or Firm* — Marshall, Gerstein & Borun LLP

(57) ABSTRACT

A transfer or feed drum for filter or cigarette portions, the drum having: a central body mounted to rotate about a first axis of rotation; a number of movable assemblies, each of which is fitted to the central body to rotate, with respect to the central body, about a respective second axis of rotation parallel to the first axis of rotation, and supports a pickup or feed head having at least one seat with a U-shaped cross section and for engaging at least one filter or cigarette portion; and an actuating system, which controls the angular position of each movable assembly about the respective second axis of rotation as a function of the angular position of the central body about the first axis of rotation.

18 Claims, 9 Drawing Sheets

(56) References Cited

U.S. PATENT DOCUMENTS

| | | | | |
|---|---|---|---|---|
| 2007/0107740 | A1* | 5/2007 | Draghetti et al. | 131/88 |
| 2010/0012133 | A1* | 1/2010 | Balletti et al. | 131/58 |

FOREIGN PATENT DOCUMENTS

| | | | | | |
|---|---|---|---|---|---|
| DE | 199 13 849 | A1 | | 10/2000 | |
| EP | 1 639 907 | A1 | | 3/2006 | |
| EP | 1 704 788 | A1 | | 9/2006 | |
| EP | 1 815 757 | A1 | | 8/2007 | |
| EP | 2 145 552 | A2 | | 1/2010 | |
| EP | 2 251 283 | A1 | | 11/2010 | |
| EP | 2 294 934 | A2 | | 3/2011 | |
| WO | WO 2005/089574 | | * | 9/2005 | A24C 5/28 |
| WO | WO-2005/089574 | A1 | | 9/2005 | |

* cited by examiner

TRANSFER OR FEED DRUM, WITH RADIAL-ARM-MOUNTED OPERATING HEADS, FOR FILTER OR CIGARETTE PORTIONS

CROSS-REFERENCE TO RELATED APPLICATIONS

This application claims the benefit of Italian Patent Application No. BO2011A 000158, filed Mar. 28, 2011.

TECHNICAL FIELD

The present invention relates to a transfer or feed drum for filter or cigarette portions.

The present invention may be used to advantage on a transfer drum for filter in a combination-filter manufacturing machine, to which the following description refers purely by way of example.

BACKGROUND ART

A combination cigarette filter manufacturing machine comprises a combining unit for forming groups of filter portions, each comprising at least two different filter portions aligned axially and contacting end to end; a wrapping unit, which receives a succession of groups of filter portions from the combining unit, wraps a strip of wrapping material about the succession of groups of filter portions to form a continuous filter rod, and cuts the combination filters from the continuous filter rod by cyclically cutting the continuous filter rod crosswise; and a transfer unit, which transfers the groups of filter portions from the combining unit, in which the groups of filter portions travel crosswise (i.e. perpendicularly to their axes), to the wrapping unit, in which the groups of filter portions travel axially (i.e. parallel to their axes). In other words, the transfer unit alters the way in which the groups of filter portions travel, by receiving them travelling crosswise, and releasing them travelling axially.

Known transfer units comprise at least one release drum, which receives the groups of filter portions from the combining unit; and a transfer drum, which removes the groups of filter portions from the release drum, and feeds them successively onto a forming beam of the wrapping unit. On known transfer units, the transfer drum is a "spider" type, i.e. has a number of suction pickup heads, which are rotated about a central axis of rotation, remaining parallel to themselves at all times, and are fitted to supporting arms projecting axially, i.e. from the end wall, of the transfer drum.

To increase output (i.e. the number of items produced per unit of time) while at the same time improving quality, "twin-line" wrapping units have been proposed, i.e. having a horizontal forming beam with two parallel grooves, in each of which a respective strip of wrapping material is wrapped about a continuous succession of groups of filter portions. In this case, the transfer unit comprises two release drums, which divide the groups of filter portions from the combining unit into two streams; and the transfer drum has "twin" suction seats, each of which removes two groups of filter portions simultaneously from the two release drums, and feeds them simultaneously onto the forming beam of the wrapping unit. Examples of transfer units of this sort are described in Patent Applications EP1787534A1 and EP2145552A2.

On transfer units with two release drums, however, installing a "spider" type transfer drum poses serious problems, on account of the inevitable size of the release drums. That is, the transfer drum must be located a fairly long distance from the release drums, which means the supporting arms projecting axially from the transfer drum to support the suction pickup heads are substantially Z-shaped and, more importantly, extremely long, thus making it difficult to position the suction pickup heads accurately when the transfer drum is rotating. Moreover, as the transfer drum rotates, the suction pickup heads tend to vibrate slightly and spin out of position; and, because of the length and shape of the supporting arms, suction to the pickup heads is not as effective as it should be, on account of the long, "winding" route, and therefore serious load losses and pneumatic inertia, of the pneumatic circuit of each pickup head (i.e. a considerable time lapse exists between suction being activated/deactivated at the start of the pneumatic circuit, and being activated/deactivated at the corresponding pickup head.

DESCRIPTION OF THE INVENTION

It is an object of the present invention to provide a transfer or feed drum for filter or cigarette portions, designed to eliminate the above drawbacks, and which is cheap and easy to produce.

According to the present invention, there is provided a transfer or feed drum for filter or cigarette portions, as claimed in the accompanying Claims.

BRIEF DESCRIPTION OF THE DRAWINGS

A number of non-limiting embodiments of the present invention will be described by way of example with reference to the accompanying drawings, in which.

PREFERRED EMBODIMENTS OF THE INVENTION

Figure 1:
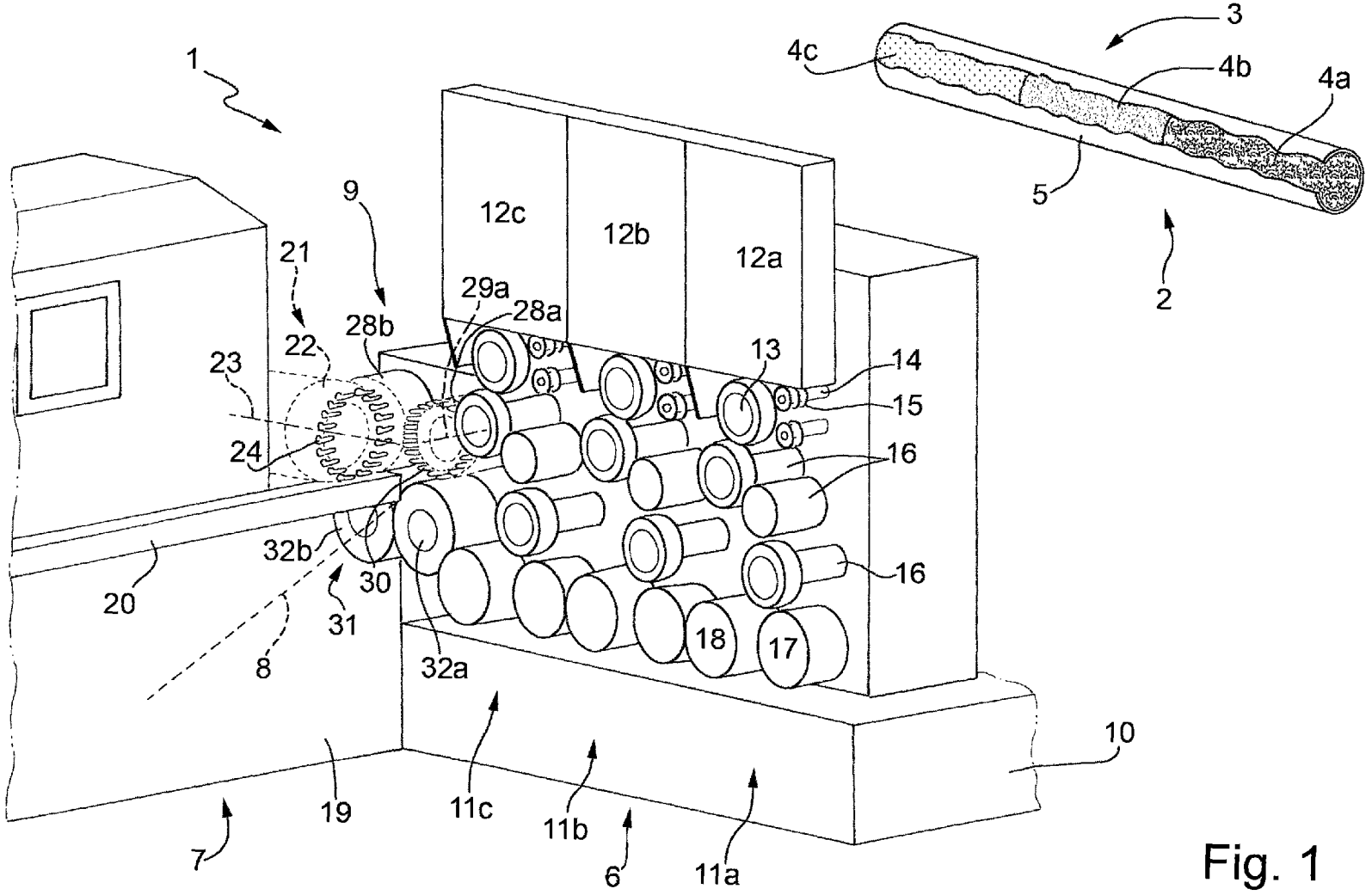
FIG. 1 shows a schematic view in perspective of a combination cigarette filter manufacturing machine featuring a filter portion transfer drum in accordance with the present invention.
Figure 2:
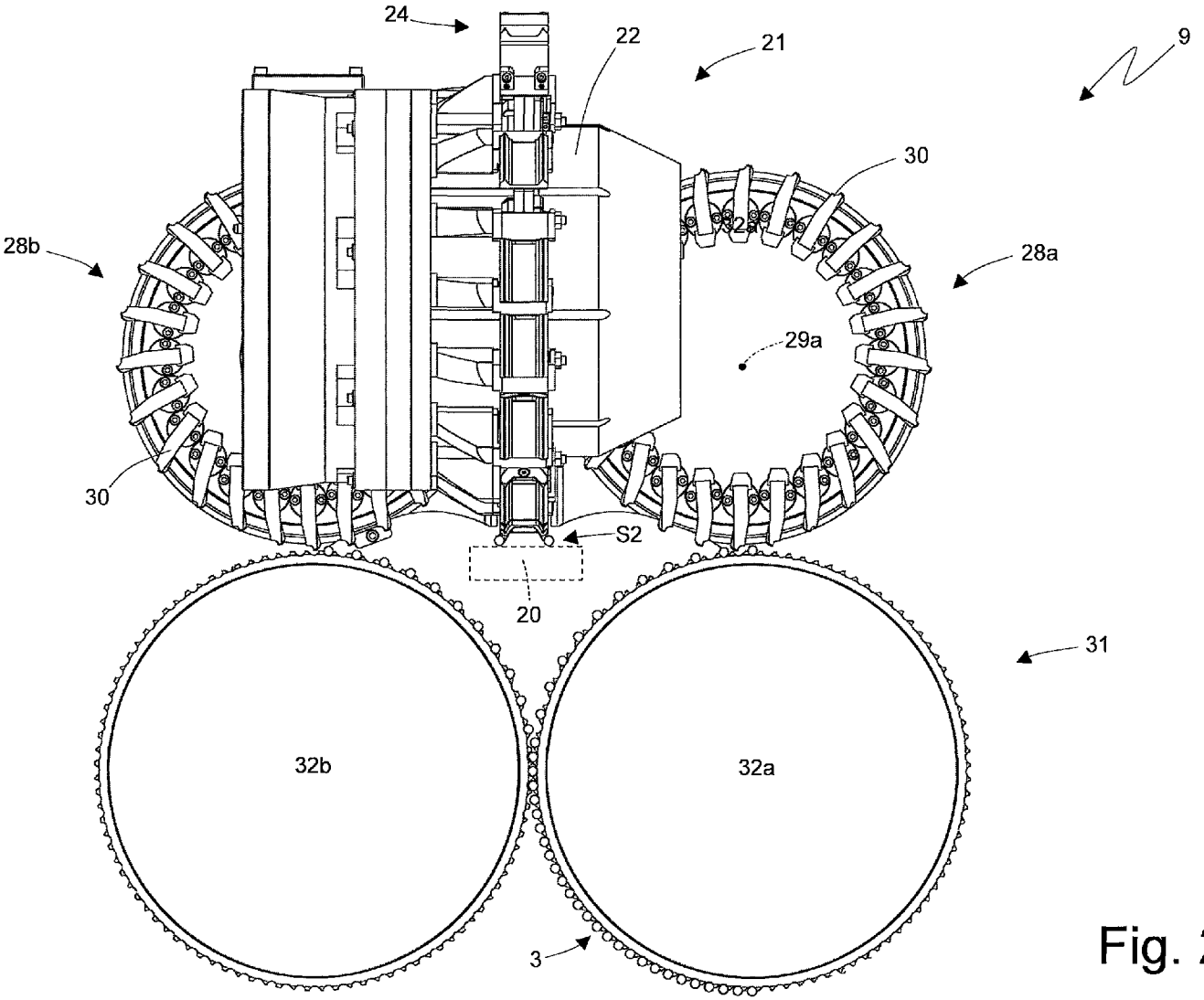
FIG. 2 shows a schematic side view of a transfer unit of the FIG. 1 manufacturing machine, featuring the filter portion transfer drum.

Number 1 in FIG. 1 indicates as a whole a manufacturing machine for producing combination cigarette filters 2, each of which comprises a group 3 of filter portions 4 wrapped in a sheet 5 of wrapping material folded into a tube and secured with glue.

Manufacturing machine 1 comprises a combining unit 6 for forming groups 3 of filter portions 4, each comprising three different filter portions 4 aligned axially and contacting end to end; a wrapping unit 7, which receives a succession of groups 3 of filter portions 4 from combining unit 6, wraps a strip 8 of wrapping material about the succession of groups 3 of filter portions 4 to form a continuous filter rod (not shown in detail), and cuts the individual combination filters 2 from the continuous filter rod by cyclically cutting the continuous filter rod crosswise; and a transfer unit 9, which transfers the groups 3 of filter portions 4 from combining unit 6, in which the groups 3 of filter portions 4 travel crosswise (i.e. perpendicularly to their axes), to wrapping unit 7, in which the groups 3 of filter portions 4 travel axially (i.e. parallel to their axes).

Combining unit 6 comprises a frame 10, which stands on the floor and supports three structurally identical feed stations 11, each for supplying respective filter portions 4 from which to form groups 3. Each feed station 11 comprises a top hopper 12 housing a mass of respective filter portions 4 of a length which is a multiple of the final length; a takeout drum 13, which withdraws filter portions 4 successively from the bottom of hopper 12, and cooperates with two cutting drums 14 fitted with respective circular blades 15 to cut filter portions 4 crosswise to the desired length; a series of three aligning drums 16, which receive and align the cut filter portions 4 from takeout drum 13; an insertion drum 17, which receives groups 3 of filter portions 4 from a preceding feed station 11, or, in the case of the first feed station 11, creates groups 3 of filter portions 4, and inserts the filter portions 4 received from the last aligning drum 16 into respective groups 3 of filter portions 4; and an output drum 18, which receives the groups 3 of filter portions 4 from insertion drum 17, and transfers them to the next feed station 11, or, in the case of the last feed station 11, to transfer unit 9.

Figure 8:
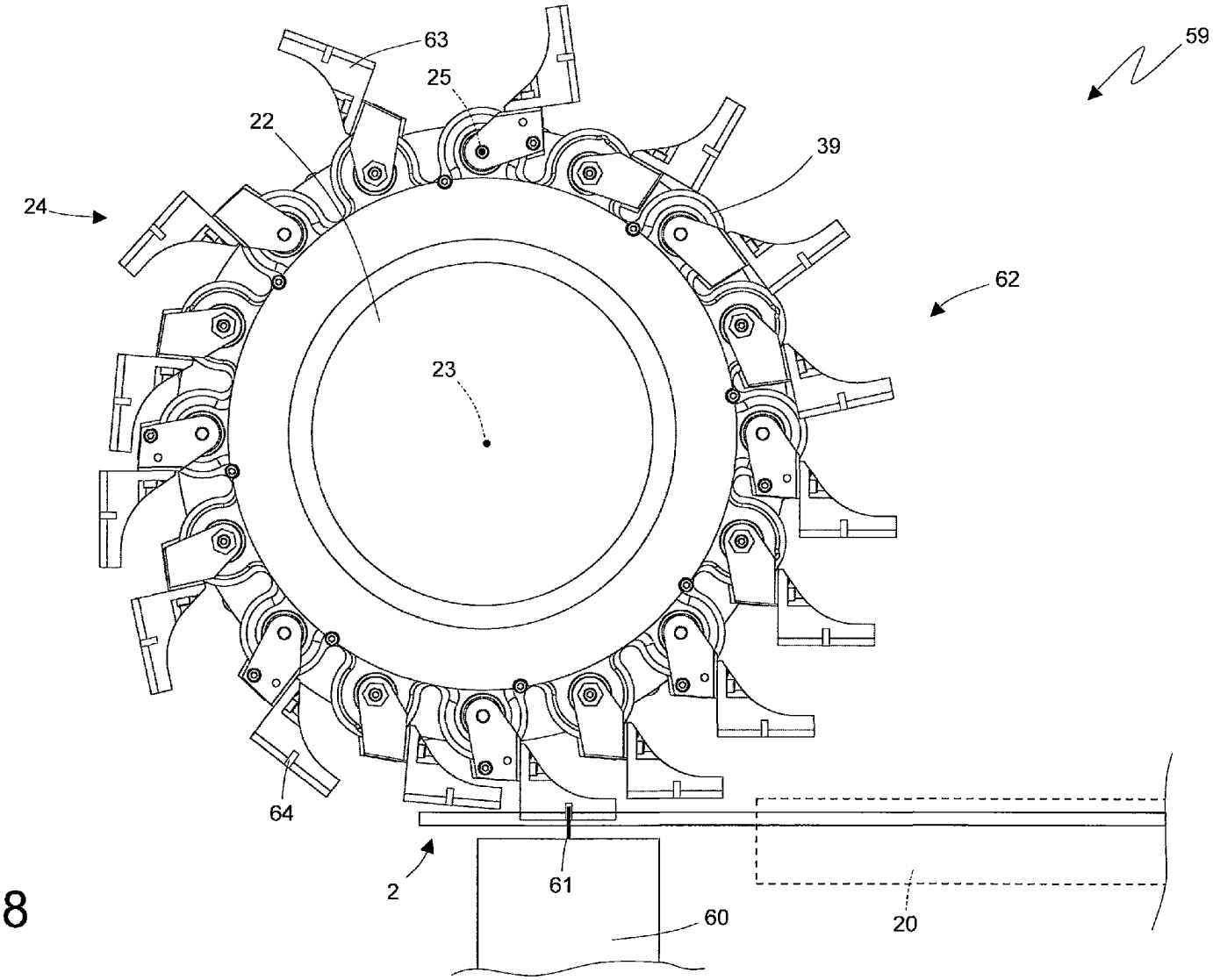
FIG. 8 shows a schematic of a cutting assembly of a wrapping unit of the FIG. 1 manufacturing machine, featuring a filter portion feed drum in accordance with the present invention.

Wrapping unit 7 is a twin-line type, and comprises a frame 19, which stands on the floor and supports a horizontal forming beam 20 with two parallel grooves, inside each of which a strip 8 of wrapping material is wrapped about a continuous succession of groups 3 of filter portions 4, arranged contacting end to end and travelling in a direction parallel to their longitudinal axes, to form a continuous filter rod (shown in FIG. 8).

Transfer unit 9 is of the type descried in Patent Application EP1787534A1, to which the reader is referred for a more detailed description of its design and operation.

Figure 5:
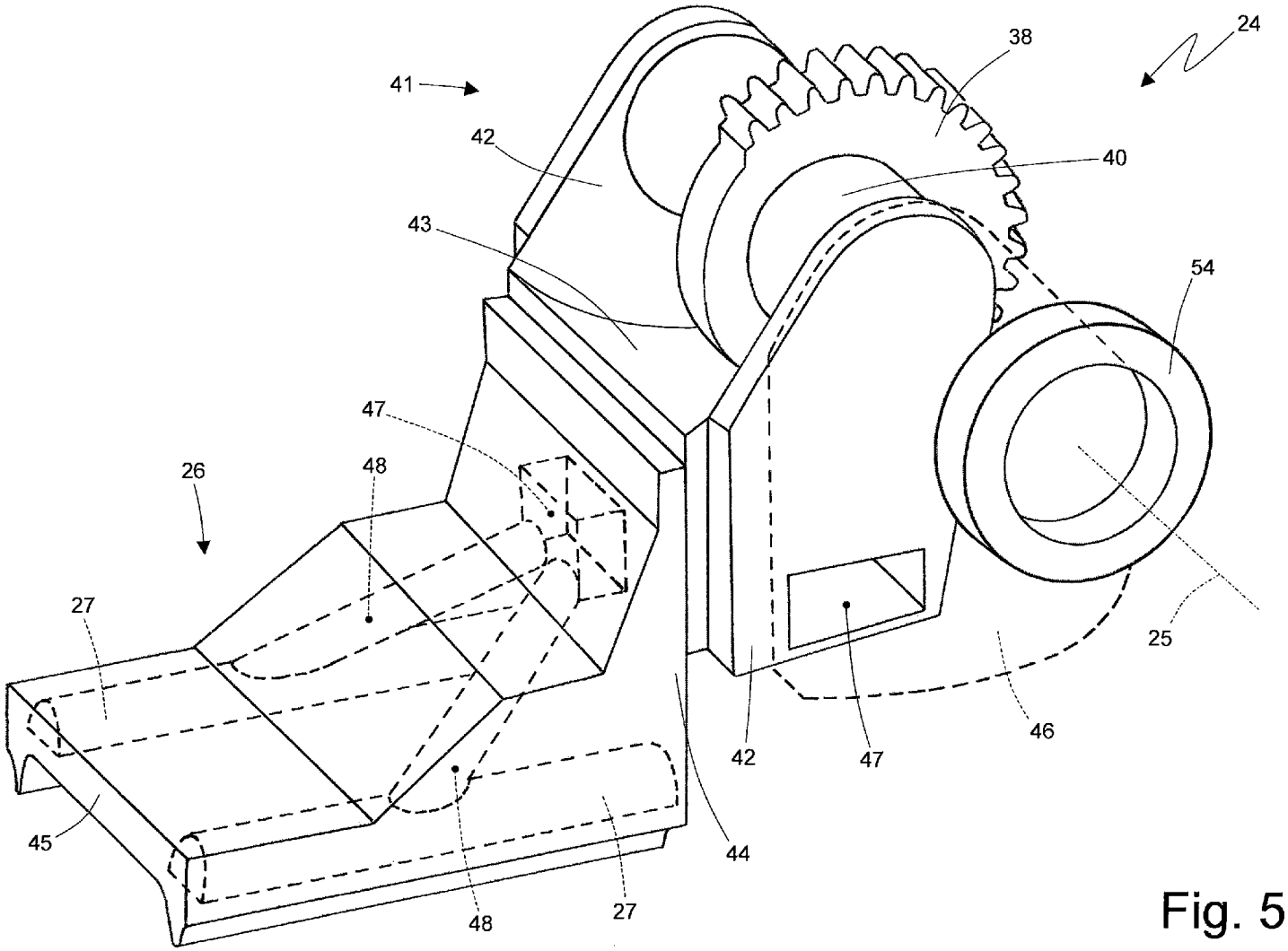
FIG. 5 shows a schematic view in perspective of a movable assembly of the filter portion transfer drum in FIG. 2.
Figure 6:
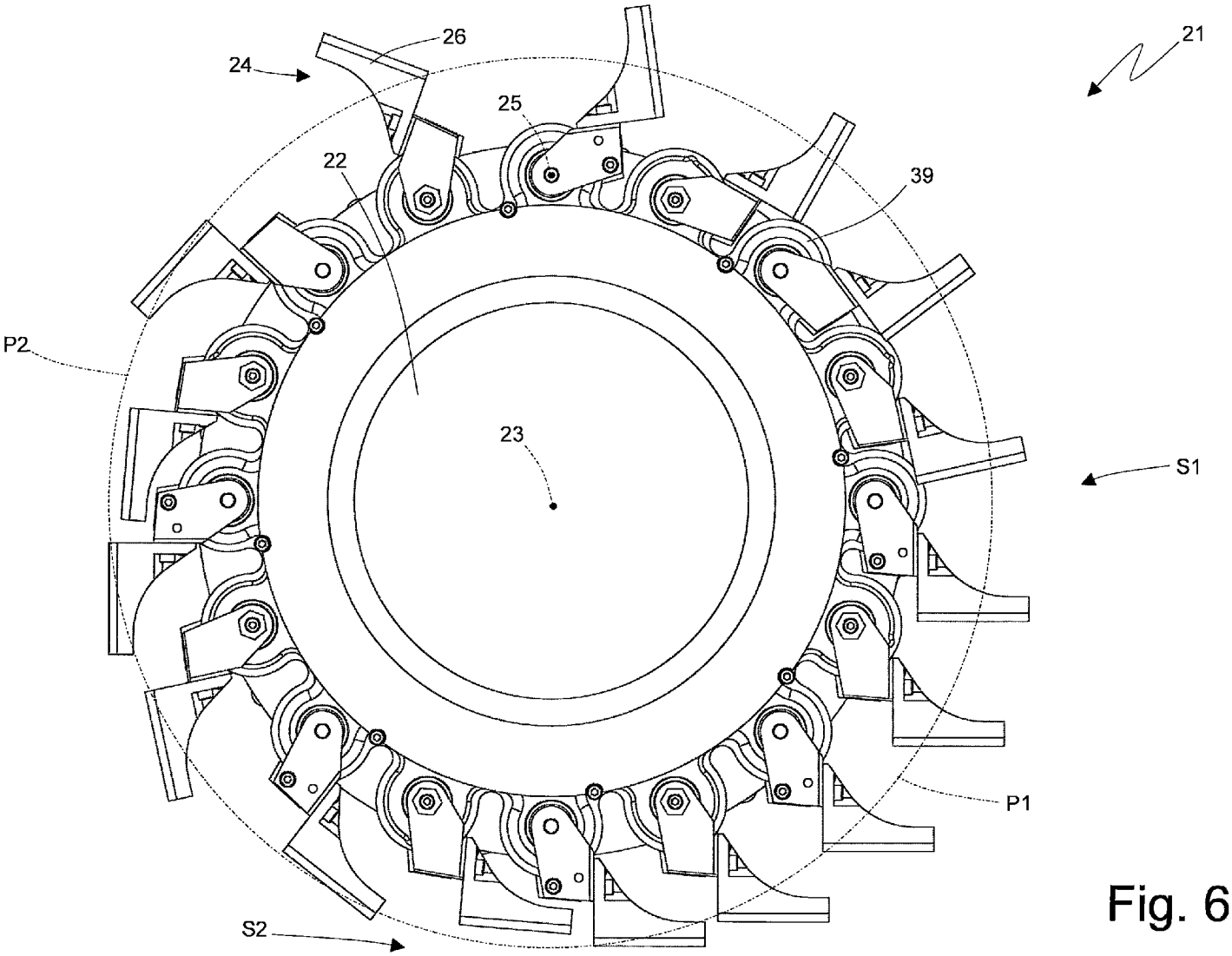
FIG. 6 shows a schematic front view of the filter portion transfer drum in FIG. 2.

Transfer unit 9 is fitted to frame 10 of combining unit 6, and comprises a transfer drum 21 comprising a central body 22, which rotates continuously about a horizontal axis of rotation 23, and supports a number of movable assemblies 24. Each movable assembly 24 projects radially from a cylindrical lateral wall of central body 22, and is fitted to central body 22 to rotate, with respect to central body 22 and as this rotates, about a respective axis of rotation 25 parallel to axis of rotation 23 of central body 22. Each assembly 24 supports a suction pickup head 26 (shown in FIGS. 3-7) equipped with two parallel suction seats 27 (shown in FIG. 5), which have a U-shaped cross section, simultaneously withdraw two groups 3 of filter portions 4 from the two release drums 28*a* and 28*b* at a takeout station S1 (FIG. 6), and simultaneously insert the two groups 3 of filter portions 4 into the two grooves in forming beam 20 at a release station S2 (FIG. 6). In other words, the two suction seats 27 of each suction pickup head 26 of transfer drum 21 simultaneously receive a group 3 of filter portions 4 from release drum 28*a* and another group 3 of filter portions 4 from release drum 28*b* at takeout station S1, and simultaneously insert the two groups 3 of filter portions 4 into the two grooves in forming beam 20 at release station S2.

The two release drums 28 are arranged side by side and parallel, are mounted to rotate about respective parallel horizontal axes of rotation 29 perpendicular to axis of rotation 23 of central body 22, and each have radial arms 30 mounted to rotate about axes of rotation parallel to axis of rotation 29 of release drum 28, and fitted on the ends with respective suction seats for groups 3 of filter portions 4.

Transfer unit 9 comprises a dividing assembly 31, which divides one stream of groups 3 of filter portions 4 from combining unit 6 into two symmetrical streams of groups 3 of filter portions 4, which are fed to the two release drums 28 and by these to transfer drum 21. Dividing assembly 31 comprises a dividing drum 32*a*, which receives one stream of filter portions 4 from combining unit 6, and feeds a first stream of filter portions 4 to release drum 28*a* located over dividing drum 32*a*; and a dividing drum 32*b*, which receives a second stream of filter portions 4 from dividing drum 32*a*, and feeds it to release drum 28*b* located over dividing drum 32*b*.

As shown in FIG. 6, transfer drum 21 rotates continuously (i.e. at constant speed) about central axis of rotation 23, so each movable assembly 24 on transfer drum 21 travels cyclically along a circular path having an active portion P1, which extends from takeout station S1 to release station S2 (and along which suction pickup head 26 of each movable assembly 24 carries two groups 3 of filter portions 4), and a passive portion P2, which is complementary to active portion P1 and extends from release station 32 to takeout station S1 (and along which suction pickup head 26 of each movable assembly 24 carries no groups 3 of filter portions 4).

Figure 4:
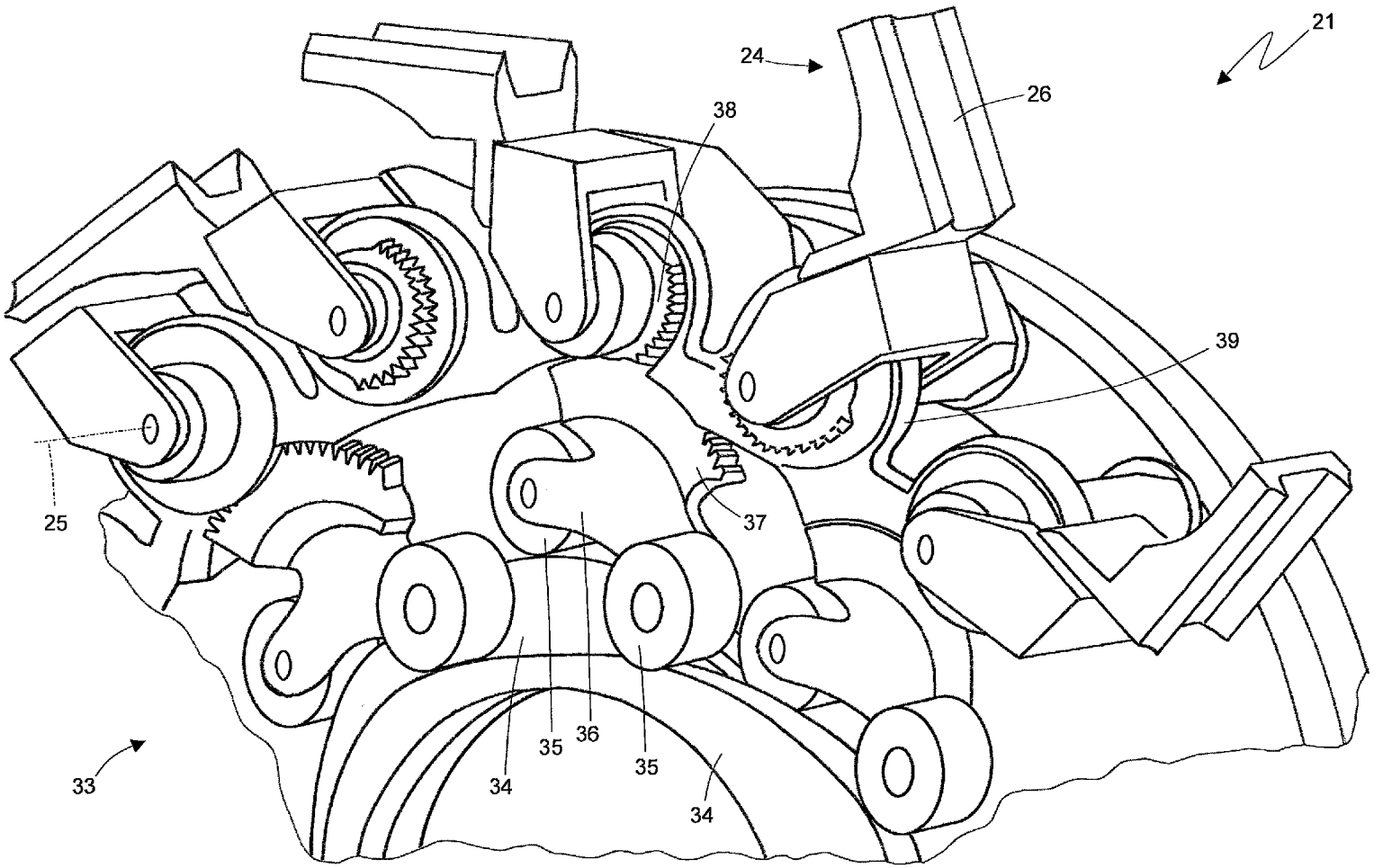
FIG. 4 shows a schematic view in perspective, with parts removed for clarity, of an actuating system of the filter portion transfer drum in FIG. 2.

As shown in FIG. 4, transfer drum 21 comprises a cam actuating system 33, which controls the angular position of each movable assembly 24 about respective axis of rotation 25 as a function of the angular position of central body 22 about axis of rotation 23. More specifically, actuating system 33 only rotates each movable assembly in the opposite direction to rotation of central body 22, to keep the two suction seats 27 of each movable assembly 24 parallel to a work plane defined by forming beam 20, along active portion P1 of the circular path travelled by movable assembly 24 in the course of a complete turn of central body 22; whereas, along passive portion P2 of the circular path, actuating system 33 does not keep the two suction seats 27 of each movable assembly 24 parallel to the work plane defined by forming beam 20, and rotates each movable assembly 24 in the same direction as rotation of central body 22 along at least part of passive portion P2 of the circular path.

Along active portion P1 of the circular path, each movable assembly 24 must be oriented to permit transfer of groups 3 of filter portions 4, so the two suction seats 27 of each movable assembly 24 are kept parallel at all times to the work plane defined by forming beam 20. Along passive portion P2 of the circular path, on the other hand, the orientation of each movable assembly 24 is less constrained, and is selected to achieve a seamless transition between passive portion P2 and active portion P1 at stations S1 and S2, and to prevent each movable assembly 24 from interfering mechanically with the other movable assemblies 24 or other parts of manufacturing machine 1.

Actuating system 33 comprises two fixed cams 34 extending about axis of rotation 23 of central body 22; and, for each movable assembly 24, two cam followers 35 (i.e. idle rollers rolling along cams 34) connected mechanically to movable assembly 24. More specifically, actuating system 33 comprises, for each movable assembly 24, a rocker arm 36 which is located inside central body 22, is fitted to central body 22 to rotate about an axis of rotation parallel to axis of rotation 25 of movable assembly 24, has two ends fitted in rolling manner with the two cam followers 35, and has an inner sector gear 37 (which is therefore angularly integral with the two cam followers 35). For each movable assembly 24, actuating system 33 also comprises an outer sector gear 38, which is angularly integral with (more specifically, integrated in) movable assembly 24, and meshes with the corresponding inner sector gear 37, so that rotation of each rocker arm 36 by the varying profiles of cams 34 is transmitted to movable assembly 24 (i.e. the two sector gears 37 and 38 form a gear drive to transmit rotation from rocker arm 36 to movable assembly 24). In a preferred embodiment shown in FIG. 4, rocker arms 36 are located alternately on two different faces of central body 22 for reasons of space.

Figure 3:
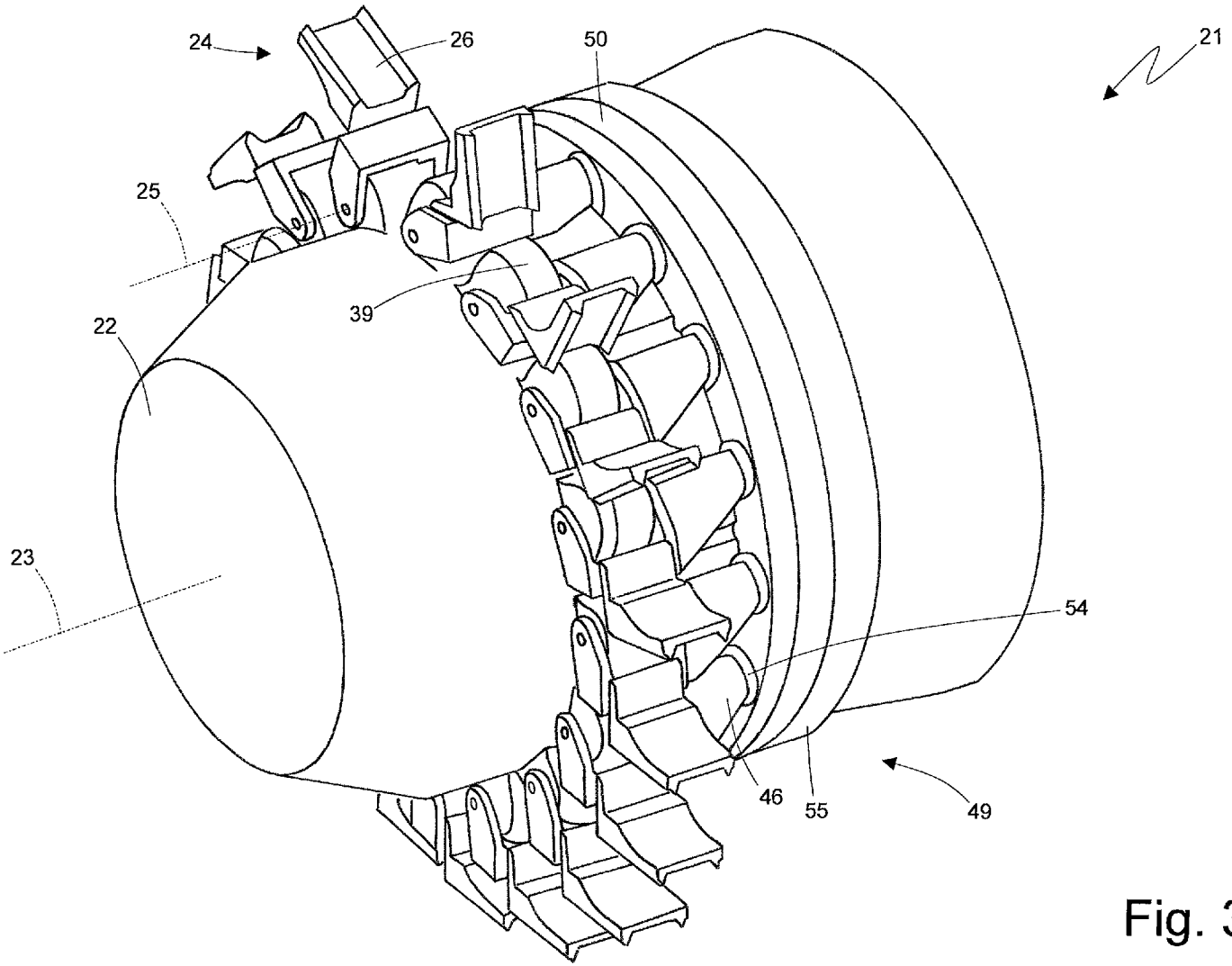
FIG. 3 shows a schematic view in perspective of the filter portion transfer drum in FIG. 2.

As shown in FIGS. 3 and 4, for each movable assembly 24, central body 22 comprises a radial projection 39, to which movable assembly 24 is fitted for rotation. As shown in FIG. 5, each movable assembly 24 comprises a shaft 40 fitted in rotary manner inside corresponding radial projection 39 with the interposition of two bearings; and a U-shaped supporting bracket 41, which has two opposite legs 42, each angularly integral with shaft 40, and a crosspiece 43 connecting legs 42 and supporting suction pickup head 26. More specifically, suction pickup head 26 is fixed to crosspiece 43 of supporting bracket 41 by two screws for fast removal and replacement when switching from one brand to another (i.e. when setting up machine 1 to produce a different type of combination filter 2). As shown in FIG. 5, each suction pickup head 26 is L-shaped, and has a wall 44 fixed to crosspiece 43 of supporting bracket 41; and a wall 45 perpendicular to wall 44 and supporting the two suction seats 27 (or rather, in which the two suction seats 27 are formed).

Each movable assembly 24 comprises a suction conduit 46, which at one end is integral with a leg 42 of supporting bracket 41, and at the other end is connectable to a suction source as described below. A channel 47 originates at the leg 42 fitted to suction conduit 46, extends through leg 42 and crosspiece 43, and connects suction pickup head 26 to suction conduit 46. And suction pickup head 26 comprises another two channels 48 connecting the two suction seats 27 to channel 47.

Figure 7:
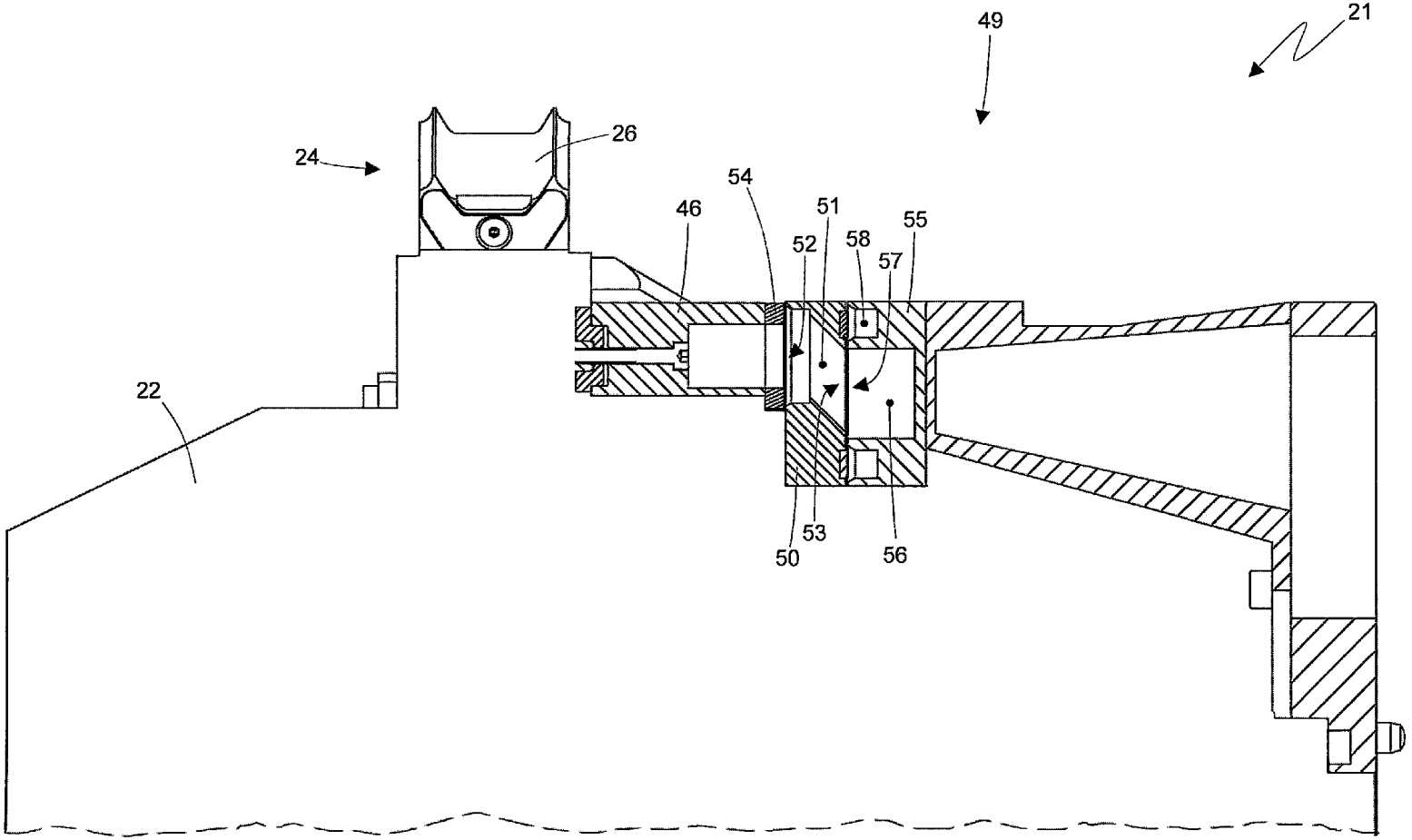
FIG. 7 shows a partly cross sectioned view of part of the filter portion transfer drum in FIG. 2.

As shown in FIGS. 3 and 7, transfer drum 21 comprises a suction system 49 for applying suction to each suction seat 27. Suction system 49 comprises a movable ring 50 fitted to central body 22 and having internally, for each movable assembly 24, a movable chamber 51, which is isolated from the movable chambers 51 of the other movable assemblies 24, and has an outer opening 53 on one side, and, on the opposite side, an inner opening 52 connected to suction seats 27 of the corresponding movable assembly 24. In other words, movable ring 50 is divided internally into a number of movable chambers 51, each of which is located alongside (i.e. associated with) a respective movable assembly 24, and extends along a short arc inside movable ring 50 (i.e. is isolated from movable chambers 51 of the other movable assemblies 24). One end of suction conduit 46 of each movable assembly 24 is integral with a leg 42 of supporting bracket 41 (and so opens inside corresponding channel 47), while the opposite end is connected by a rotary coupling 54 to movable ring 50 fitted to central body 22, so as to communicate with respective movable chamber 51. In other words, one end of suction conduit 46 of each movable assembly 24 is fitted in rotary manner to movable ring 50 at inner opening 52 of respective movable chamber 51, so as to communicate with respective movable chamber 51.

Suction system 49 also comprises a fixed ring 55 located in a fixed position alongside and coaxial with movable ring 50, and which forms a sliding contact with movable ring 50 (i.e. as central body 22 rotates, movable ring 50 slides on fixed ring 55). Inside, fixed ring 55 has a fixed suction chamber 56 connectable in known manner to a known suction source (not shown) and having an arc-shaped inner opening 57 which communicates with outer opening 53 of each movable chamber 51 when the corresponding movable assembly 24 is located along active portion P1 of the circular path. In other words, inner opening 57 of fixed suction chamber 56 is designed (i.e. located and sized) to only communicate with (i.e. open into) outer opening 53 of each movable chamber 51 when the corresponding movable assembly 24 is located along active portion P1 of the circular path. Movable chamber 51 of each movable assembly 24 therefore only communicates with fixed suction chamber 56, i.e. is only connected to the suction source, when movable assembly 24 is located along active portion P1 of the circular path (i.e. when the two suctions seats 27 of movable assembly 24 need to retain respective groups 3 of filter portions 4 by suction).

In one embodiment, fixed ring 55, inside, also has a fixed release chamber 56, which is complementary to fixed suction chamber 56, is connectable to the outside or to a compression source, and has an arc-shaped inner opening 57 of its own, which is complementary to inner opening 57 of fixed suction chamber 56, and communicates with outer opening 53 of each movable chamber 51 when the corresponding movable assembly 24 is located along passive portion P2 of the circular path. Movable chamber 51 of each movable assembly 24 therefore only communicates with fixed release chamber 56, i.e. is not connected to the suction source (and may even be connected to a compression source to assist release of respective groups 3 of filter portions 4) when movable assembly 24 is located along passive portion P2 of the circular path (i.e. when the two suction seats 27 of movable assembly 24 do not need suction to retain respective groups 3 of filter portions 4).

In a preferred embodiment, fixed ring 55 is fitted with two annular seals 58 housed in respective seats on radially opposite sides of inner opening 57, and which slide on movable ring 50.

Transfer drum 21 described above and forming part of transfer unit 9 of manufacturing machine 1 has numerous advantages.

Firstly, it is cheap and easy to produce, on account of movable assemblies 24 fitted with suction pickup heads 26 being located close to the lateral wall of central body 22, so the radial projections 39 supporting movable assemblies 24 on central body 22 are short.

Secondly, as a whole, movable assemblies 24 of transfer drum 21 described are extremely rigid, mechanically strong, and precise, so the suction pickup heads 26 are substantially immune to vibration and deformation as transfer drum 21 rotates.

Lastly, in transfer drum 21 described, suction is effectively applied to suction pickup heads 26, by virtue of the short, highly 'linear' (i.e. non-winding) route of the pneumatic circuit of each suction pickup head 26, which also reduces the load losses and pneumatic inertia of the pneumatic circuit.

Figure 9:
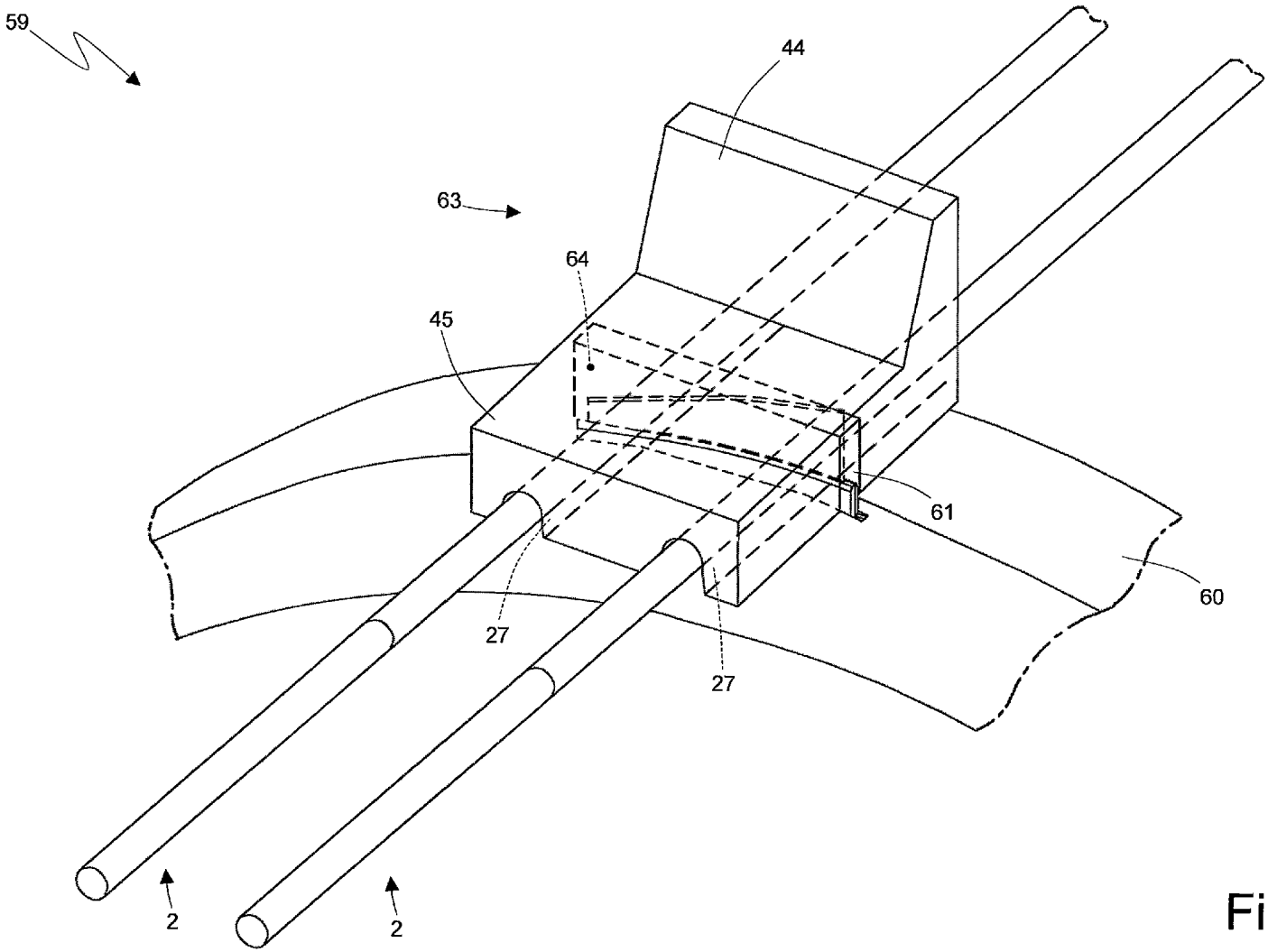
FIG. 9 shows a schematic detail, with parts removed for clarity, of the FIG. 8 cutting assembly.

As shown in FIGS. 8 and 9, wrapping unit 7 of manufacturing machine 1 comprises a cutting assembly 59 located downstream from forming beam 20 to cyclically cut the two filter rods (only one shown in FIG. 8) from forming beam 20 crosswise into combination filters 2.

Cutting assembly 59 comprises a cutting drum 60, which rotates about a central axis of rotation and has at least one radial blade 61 to cut both the filter rods from forming beam 20 in rapid succession; and a feed drum 62 equipped with a number of feed heads 63, each supporting two blade guide seats 27 with U-shaped cross sections. Each blade guide seat 27 is advanced by feed drum 62 a given distance together with and enclosing the corresponding filter rod, and has a transverse through slit 64 (i.e. crosswise to the travelling direction of the filter rods), through which blade 61 of cutting drum 60 moves during the cutting operation. In other words, feed drum 62 advances the two blade guide seats 27 of each feed head 63 a given distance together with the filter rods, so each blade guide seat 27 encloses and moves synchronously with the respective filter rod as this is cut crosswise by radial blade 61 of cutting drum 60.

Feed drum 62 with feed heads 63 is identical to transfer drum 21 with suction pickup heads 26. That is, mechanically, feed drum 62 is substantially identical to transfer drum 21, the only substantial difference being that suction pickup heads 26 on transfer drum 21 are replaced with feed heads 63 on feed drum 62 (i.e. movable assemblies 24 are fitted with feed heads 63, as opposed to suction pickup heads 26). Also, feed heads 63 on feed drum 62 are not normally suction-operated, so feed drum 62 has no suction system 49.

All the advantages described in relation to transfer drum 21 therefore also apply to feed drum 62.

The invention claimed is:

1. A transfer or feed drum (21; 62) for filter or cigarette portions (4), the drum (21; 62) comprising:

a central body (22) mounted to rotate about a first axis of rotation (23);

a number of movable assemblies (24), each of which is fitted to the central body (22) to rotate, with respect to the central body (22), about a respective second axis of rotation (25) parallel to the first axis of rotation (23), and supports a pickup or feed head (26; 63) having at least one seat (27) with a U-shaped cross section and for engaging at least one filter or cigarette portion (4); and an actuating system (33), which controls the angular position of each movable assembly (24) about the respective second axis of rotation (25) as a function of the angular position of the central body (22) about the first axis of rotation (23);

wherein each movable assembly (24) projects radially from a cylindrical lateral wall of the central body (22);

wherein in the course of a complete turn of the central body (22) each movable assembly (24) travels along a circular path constituted by an active portion (P1) along which the seat (27) engages at least one filter or cigarette portion (4), and by a passive portion (P2) complementary to the active portion (P1) and along which the seat (27) does not engage any filter or cigarette portion (4);

wherein the actuating system (33) only rotates each movable assembly in the opposite direction to rotation of the central body (22), to keep the seat (27) of each movable assembly (24) parallel to a work plane, along the whole active portion (P1) of the circular path; and wherein the actuating system (33) rotates each movable assembly (24) in the same direction as rotation of the central body (22) along at least a portion of the passive portion (P2) of the circular path.

2. The drum (21; 62) as claimed in claim 1, wherein the actuating system (33) comprises at least one fixed cam (34) extending about the first axis of rotation (23); and, for each movable assembly (24), a respective cam follower (35) connected mechanically to the movable assembly (24).

3. The drum (21; 62) as claimed in claim 2, wherein the actuating system (33) comprises two fixed cams (34) extending about the first axis of rotation (23); and, for each movable assembly (24), two respective cam followers (35) connected mechanically to the movable assembly (24).

4. The drum (21; 62) as claimed in claim 2, wherein, for each movable assembly (24), the actuating system (33) comprises an inner sector gear (37) angularly integral with the corresponding cam follower (35); and an outer sector gear (38) angularly integral with the movable assembly (24) and meshing with the inner sector gear (37).

5. The drum (21; 62) as claimed in claim 1, wherein, for each movable assembly (24), the central body (22) comprises a radial projection (39) on which the movable assembly (24) is mounted for rotation.

6. The drum (21; 62) as claimed in claim 5, wherein each movable assembly (24) comprises:

a shaft (40) mounted for rotation in the corresponding radial projection (39); and a U-shaped supporting bracket (41) having two opposite legs (42), each angularly integral with the shaft (40); and a crosspiece (43) connecting the two legs (42) and supporting the pickup or feed head (26; 63).

7. The drum (21; 62) as claimed in claim 6, wherein each seat (27) is a suction seat, and each movable assembly (24) comprises a suction conduit (46), which at one end is integral with a leg (42) of the supporting bracket (41), and at the other end has a rotary coupling connecting it to a movable ring (50) fitted to the central body (22).

8. The drum (21; 62) as claimed in claim 6, wherein each pickup or feed head (26; 63) is L-shaped, and has a first wall (44) fixed to the crosspiece (43) of the supporting bracket (41); and a second wall (45) perpendicular to the first wall (44) and supporting the seat (27).

9. The drum (21; 62) as claimed in claim 1, wherein each seat (27) is a suction seat, and a suction system (49) is provided for applying suction to each seat (27); the suction system (49) comprising:

a movable ring (50) fitted to the central body (22) and having internally, for each movable assembly (24), a movable chamber (51) isolated from the movable chambers (51) of the other movable assemblies (24), and which has an inner opening (52), on one side, connected to the suction seat (27) of the corresponding movable assembly (24), and an outer opening (53) on the opposite side; and a fixed ring (55), which is coaxial with and located in a fixed position alongside the movable ring (50), defines a sliding contact with the movable ring (50), and has internally a fixed suction chamber (56), which is connectable to a suction source, and has an arc-shaped inner opening (57) which only communicates with the outer opening (53) of each movable chamber (51) when the corresponding movable assembly (24) is located along the active portion (P1) of the circular path.

10. The drum (21; 62) as claimed in claim 9, wherein the fixed ring (55) has a fixed release chamber (66), which is complementary to the fixed suction chamber (56), connectable to an external environment or to a compression source, and has an arc-shaped inner opening (57) which communicates with the outer opening (53) of each movable chamber (51) when the corresponding movable assembly (24) is located along the passive portion (P2) of the circular path.

11. The drum (21; 62) as claimed in claim 9, wherein the fixed ring (55) is fitted with two annular seals (58), which slide against the movable ring (50) and are located on radially opposite sides of the inner opening (57).

12. The drum (21; 62) as claimed in claim 9, wherein each movable assembly (24) comprises a suction conduit (46), which at one end is integral with the movable assembly (24), and at the other end has a rotary coupling connecting it to the movable ring (50).

13. The drum (21; 62) as claimed in claim 1, wherein the drum (21; 62) is a transfer drum (21), and the seat (27) of each movable assembly (24) transfers at least one filter or cigarette portion (4) along the active portion (P1) of the circular path.

14. The drum (21; 62) as claimed in claim 1, wherein the drum (21; 62) is a feed drum (62), and the seat (27) of each movable assembly (24) feeds at least one filter or cigarette portion (4) along at least part of the active portion (P1) of the circular path when transversely cutting the filter or cigarette portion (4).

15. A manufacturing machine (1) for producing combination cigarette filters (2), and comprising:

a combining unit (6) for forming groups (3) of filter portions (4), each comprising at least two different filter portions (4) aligned axially and contacting end to end;

a wrapping unit (7), which receives a succession of groups (3) of filter portions (4) from the combining unit (6), wraps a strip (8) of wrapping material about the succession of groups (3) of filter portions (4) to form a continuous filter rod, and cuts the combination filters (2) from the continuous filter rod by cyclically cutting the continuous filter rod crosswise; and a transfer unit (9), which transfers the groups (3) of filter portions (4) from the combining unit (6), in which the groups (3) of filter portions (4) travel crosswise, to the wrapping unit (7), in which the groups (3) of filter portions (4) travel axially, and comprises a transfer drum (21), which feeds the groups (3) of filter portions (4) successively into a forming beam (20) of the wrapping unit (7) by means of a number of suction pickup heads (26); and at least one release drum (28), which releases the groups (3) of filter portions (4) successively to the transfer drum (21);

wherein the transfer drum (21) is as claimed in claim 1.

16. The manufacturing machine (1) as claimed in claim 15, wherein the transfer unit (9) comprises:

two parallel, side by side release drums (28), each of which transfers respective groups (3) of filter portions (4) to the transfer drum (21); and a dividing assembly (31), which divides a single stream of groups (3) of filter portions (4) from the combining unit (6) into two symmetrical streams of groups (3) of filter portions (4) for supply to the two release drums (28).

17. The manufacturing machine (1) as claimed in claim 16, wherein the dividing assembly (31) comprises:

a first dividing drum (32*a*), which receives a single stream of filter portions (4) from the combining unit (6), and feeds a first stream of filter portions (4) to a first release drum (28*a*) located over the first dividing drum (32*a*); and a second dividing drum (32*b*), which receives a second stream of filter portions (4) from the first dividing drum (32*a*), and feeds the second stream of filter portions (4) to a second release drum (28*b*) located over the second dividing drum (32*b*).

18. A cutting assembly (59) for cutting at least one continuous rod transversely into a succession of filter or cigarette portions; the cutting assembly (59) comprising:

a cutting drum (60) which rotates about a central axis of rotation and has at least one radial blade (61); and a feed drum (62) comprising a number of feed heads (63), each supporting at least one blade guide seat (27), which is advanced a given distance together with and enclosing the continuous rod, and has a transverse through slit (64) through which the blade (61) of the cutting drum (60) moves during the cutting operation;

wherein the feed drum (62) is as claimed in claim 1.

* * * * *